US008287102B2

(12) United States Patent
Tseng et al.

(10) Patent No.: US 8,287,102 B2
(45) Date of Patent: Oct. 16, 2012

(54) MICRO-DROPLET EJECTION APPARATUS HAVING NOZZLE ARRAYS WITHOUT INDIVIDUAL CHAMBERS AND EJECTION METHOD OF DROPLETS THEREOF

(75) Inventors: Fan Gang Tseng, Hsinchu (TW); I Da Yang, Taichung (TW)

(73) Assignee: National Tsing Hua University, Hsinchu (TW)

( * ) Notice: Subject to any disclaimer, the term of this patent is extended or adjusted under 35 U.S.C. 154(b) by 1135 days.

(21) Appl. No.: 12/042,675

(22) Filed: Mar. 5, 2008

(65) Prior Publication Data

US 2008/0218557 A1 Sep. 11, 2008

(30) Foreign Application Priority Data

Mar. 7, 2007 (TW) ..... 96107785 A

(51) Int. Cl.
*B41J 2/05* (2006.01)

(52) U.S. Cl. ..... 347/65; 347/10

(58) Field of Classification Search ..... 347/1, 5–7, 347/9–15, 17–20, 22–23, 26–27, 40, 42–45, 347/47–51, 54–63, 65–71, 84–89, 92–95, 347/99–100; 29/25.35, 890.1; 128/200.14, 128/200.16; 216/27; 239/102.1, 102.2
See application file for complete search history.

(56) References Cited

U.S. PATENT DOCUMENTS

| | | | | |
|---|---|---|---|---|
| 6,084,609 | A * | 7/2000 | Manini et al. | 347/40 |
| 6,102,530 | A * | 8/2000 | Kim et al. | 347/65 |
| 6,364,464 | B1 * | 4/2002 | Ahn | 347/61 |
| 6,382,768 | B1 * | 5/2002 | Koitabashi et al. | 347/48 |
| 6,439,691 | B1 * | 8/2002 | Lee et al. | 347/48 |
| 6,474,763 | B1 * | 11/2002 | Murakami et al. | 347/14 |
| 2001/0020967 | A1 * | 9/2001 | Schulte | 347/65 |
| 2001/0033304 | A1 * | 10/2001 | Ishinaga et al. | 347/12 |
| 2003/0085959 | A1 * | 5/2003 | Hsu et al. | 347/65 |
| 2003/0193544 | A1 * | 10/2003 | Eguchi | 347/48 |
| 2004/0032464 | A1 * | 2/2004 | Gonzalez | 347/63 |
| 2004/0145633 | A1 * | 7/2004 | Lim et al. | 347/62 |
| 2004/0263578 | A1 * | 12/2004 | Lee et al. | 347/65 |
| 2005/0007423 | A1 * | 1/2005 | Iida et al. | 347/60 |
| 2007/0008380 | A1 * | 1/2007 | Ushinohama et al. | 347/61 |
| 2007/0103526 | A1 * | 5/2007 | Fukuda | 347/100 |

* cited by examiner

*Primary Examiner* — Charlie Peng
*Assistant Examiner* — Peter Radkowski
(74) *Attorney, Agent, or Firm* — WPAT, P.C.; Anthony King

(57) ABSTRACT

A micro-droplet ejection apparatus includes a substrate, a droplet-ejecting layer, and a plurality of bubble generators. A liquid storage space is formed between the substrate and the droplet-ejecting layer. The liquid storage space has no spacer connecting the substrate and the droplet-ejecting layer. That is, the liquid storage space has no individual chambers. The droplet-ejecting layer has a plurality of through holes arranged in an array, and each through hole is used as a nozzle for pushing out ink. The plurality of bubble generators is disposed above the substrate, and corresponds to and is disposed under the through holes. The bubble generators on two sides of a designated bubble generator generate at least one limit bubble, limiting the growth of a main bubble generated by the designated bubble generator.

27 Claims, 10 Drawing Sheets

MICRO-DROPLET EJECTION APPARATUS HAVING NOZZLE ARRAYS WITHOUT INDIVIDUAL CHAMBERS AND EJECTION METHOD OF DROPLETS THEREOF

BACKGROUND OF THE INVENTION

1. Field of the Invention

The present invention relates to a micro-droplet ejection apparatus having nozzle arrays without individual chambers and an ejection method of droplets thereof. More particularly, the present invention relates to a micro-droplet generating apparatus with high nozzle density and a method for ejecting micro-droplets.

2. Description of the Related Art

Micro-droplet ejection apparatuses are widely applied in inkjet printheads of inkjet printers. In addition, the micro-droplet ejectors can also be applied in other technical fields, for example, fuel injection systems, cell classification, pharmaceutical release systems, reagent distribution on biochips, direct jet printing photolithography, and micro-injection propelling systems. The common point of all of the above-mentioned applications is that a reliable micro-droplet ejection apparatus with low cost, high frequency, and high resolution is required.

Recently, among the known and used micro-droplet ejection apparatuses, only a few kinds of the ejection apparatuses have been able to individually eject micro-liquid drops with identical shapes. The method of ejecting the droplets with thermally driven bubbles is advantageous as it is relatively simple and the manufacturing cost is relatively low.

The disadvantages of the thermally driven bubble system (also referred to as the bubble injection system) are the problems of cross talk and satellite droplets. The bubble ejection system uses a current pulse to heat electrodes, thereby vaporizing the liquid in a fluid cavity. When the liquid is vaporized, a bubble is formed on the electrode surface and in the liquid, and expands outwards. The bubble is equivalent to a pump that ejects the liquid into the fluid cavity from a micro-nozzle orifice to form a liquid column, and to finally form a flying droplet.

When the current pulse ends, the bubble shrinks accordingly, and the liquid refills the fluid cavity through capillary tension at the same time. However, the fluid cavities corresponding to the micro-nozzle orifices are isolated by spacers, resulting in flow resistance when the liquid refills the liquid cavities. That is, the speed of the liquid refilling the liquid cavities is reduced, so the frequency of the continuous ejection of the droplets is lowered substantially. If the length of the spacers between the liquid cavities is reduced, the problems of the cross talk and the over refilling between the neighboring liquid cavities may occur.

FIG. 1 is a perspective view of a part of a micro-droplet ejection apparatus of U.S. Pat. No. 6,102,530. FIG. 1 shows a row of nozzles 10 in the micro-droplet ejection apparatus, including a plurality of fluid cavities 14, a manifold 16, a plurality of nozzles 18, a plurality of first heaters 11, and a plurality of second heaters 12. The space of each fluid cavity 14 is formed on a silicon substrate 13, and the fluid cavities 14 are spaced by spacers. Therefore, the density of the nozzles 18 in a unit area is obviously limited by the distance between the fluid cavities 14. If the distance between the fluid cavities 14 is inappropriately reduced, it is liable to induce the cross talk. On the other hand, the length of the fluid cavities 14 is relevant to the flow resistance, and the speed of the liquid 16 refilling the liquid cavities 14 is also affected by the flow resistance.

In view of the above, currently, a micro-droplet ejection apparatus with high frequency and high resolution is required, which not only solves the problems of the cross talk and the slowdown of the refilling of the liquid, but also increases the quantity of the nozzles in one unit area.

SUMMARY OF THE INVENTION

The present invention provides a micro-droplet ejection apparatus with high frequency and high resolution, which has nozzles arranged in an array, and adopts a design with no individual fluid cavities under the nozzles, thereby increasing nozzle density in a unit area.

The present invention provides a micro-droplet ejection apparatus that is easy to design and manufacture, which can be finished with a micro-electromechanical process or a common semiconductor process.

The present invention provides an ejection method for droplets, forming a bubble wrapped in the liquid on at least one side of a micro-nozzle orifice, thereby controlling the direction of expansion of a bubble in another liquid generated under the micro-nozzle orifice, so as to increase the frequency of droplet ejection and to prevent the occurrence of satellite droplets.

Accordingly, the present invention discloses a micro-droplet ejection apparatus having nozzle arrays without individual chambers, which includes a substrate, a droplet-ejecting layer, and a plurality of bubble generators. A liquid storage space is formed between the substrate and the droplet-ejecting layer. The liquid storage space has no spacers connecting the substrate and the droplet-ejecting layer. That is, the liquid storage space has no individual chambers. The droplet-ejecting layer has a plurality of through holes arranged in an array, and each through hole is used as a nozzle for pushing out ink. The plurality of bubble generators is disposed above the substrate, and is disposed under the corresponding through holes. The bubble generators on two sides of a designated bubble generator generate at least one limit bubble, limiting the growth of a main bubble generated by the designated bubble generator.

Further, the present invention discloses a micro-droplet ejection apparatus having nozzle arrays without individual chambers which includes a substrate, a droplet-ejecting layer, a plurality of bumps, and a plurality of bubble generators. A liquid storage space is formed between the substrate and the droplet-ejecting layer. The liquid storage space has no spacer connecting the substrate and the droplet-ejecting layer. That is, the liquid storage space has no individual chambers. The droplet-ejecting layer has a plurality of through holes arranged in an array, and each through hole is used as a nozzle for pushing out ink. The plurality of bubble generators is disposed above the substrate, and is disposed under the corresponding through holes. A designated bubble generator generates a bubble, and the bumps beside the designated bubble generator limit the growth of the bubble.

Further, the present invention discloses an ejection method for droplets. When a through hole is designated to eject the droplets, the bubble generator under the designated through hole instantly forms a main bubble, and at least one limit bubble is instantly formed on the periphery of the designated through hole. The limit bubble limits the direction and size of the growth of the main bubble. Finally, the continuously growing main bubble pushes a droplet away from the designated through hole.

BRIEF DESCRIPTION OF THE DRAWINGS

The invention will be described according to the appended drawings in which:

FIG. 11(*b*) is a sectional view of the micro-droplet ejection apparatus according to another embodiment of the present invention.

PREFERRED EMBODIMENT OF THE PRESENT INVENTION

The present invention is explained with the accompanying drawings as follows, so as to clearly disclose the technical features of the present invention.

Figure 1:
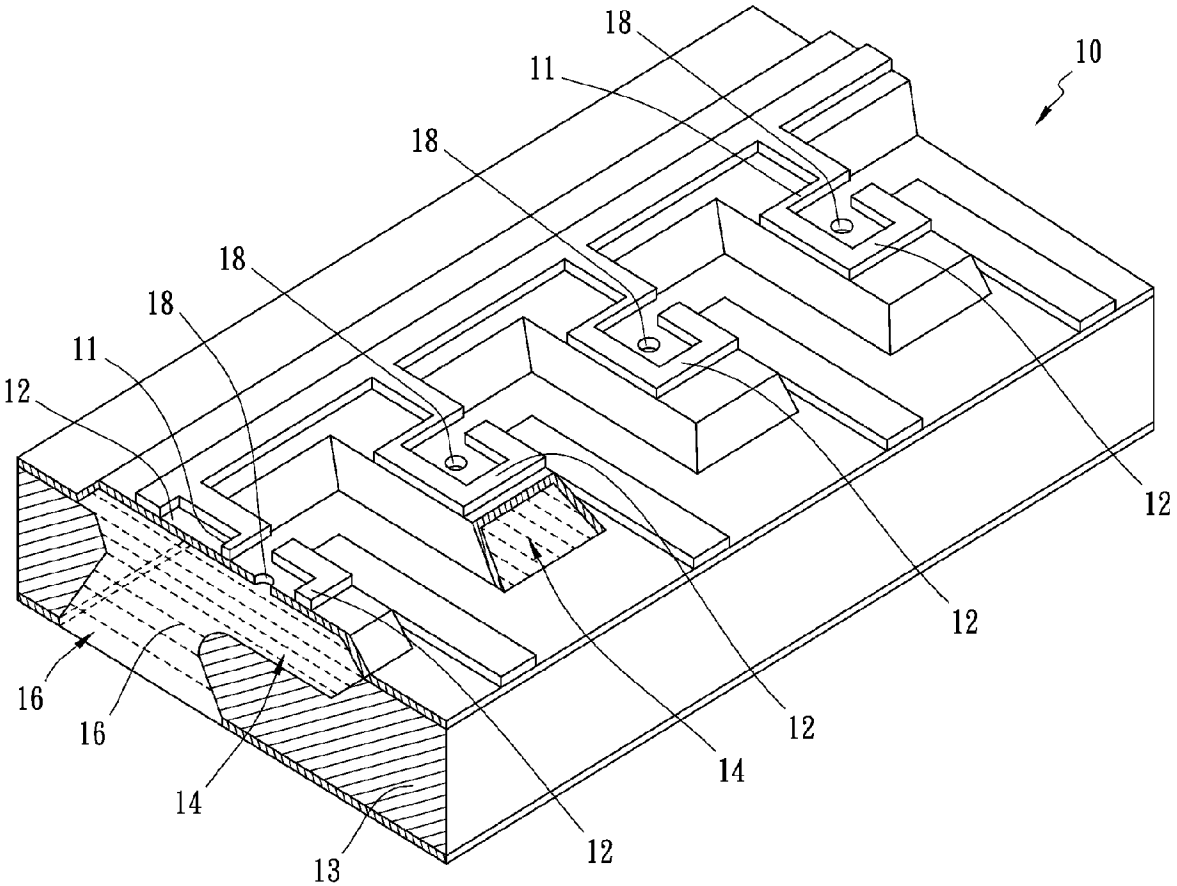
FIG. 1 (prior art)
FIG. 1 is a perspective view of a part of a micro-droplet ejection apparatus of U.S. Pat. No. 6,102,530.
Figure 2:
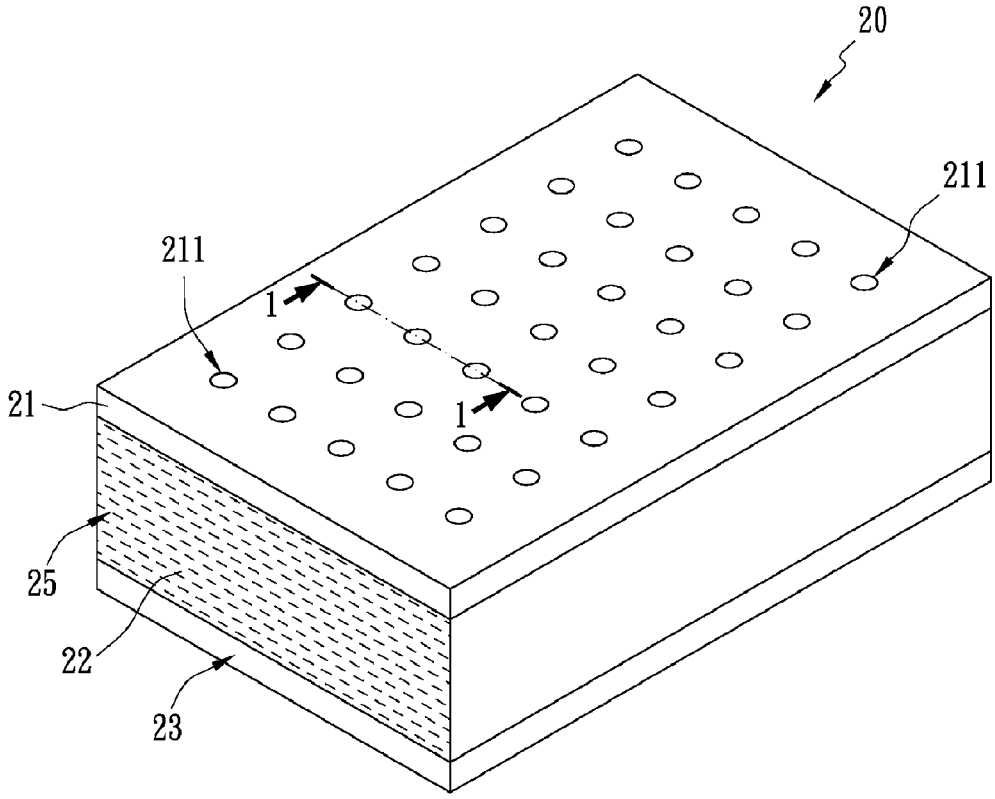
FIG. 2 is a perspective view of a part of a micro-droplet ejection apparatus according to the present invention.

FIG. 2 shows a nozzle array 20 of a micro-droplet ejection apparatus. However, the micro-droplet ejection apparatus can include a plurality of nozzle arrays 20. The nozzle array 20 includes a substrate 23, a droplet ejection layer 21, and a plurality of bubble generators 24. A liquid storage space 25 filled with ink 22 or liquid is formed between the substrate 23 and the droplet ejection layer 21. The liquid storage space 25 has no spacers connecting the substrate 23 and the droplet-ejecting layer 21. That is, the liquid storage space 25 does not have individual chambers similar to the fluid cavities 14 in FIG. 1. The droplet ejection layer 21 has a plurality of through holes 211 arranged in an array, and each through hole 211 is used as a nozzle for pushing out the ink 22.

Figure 3:
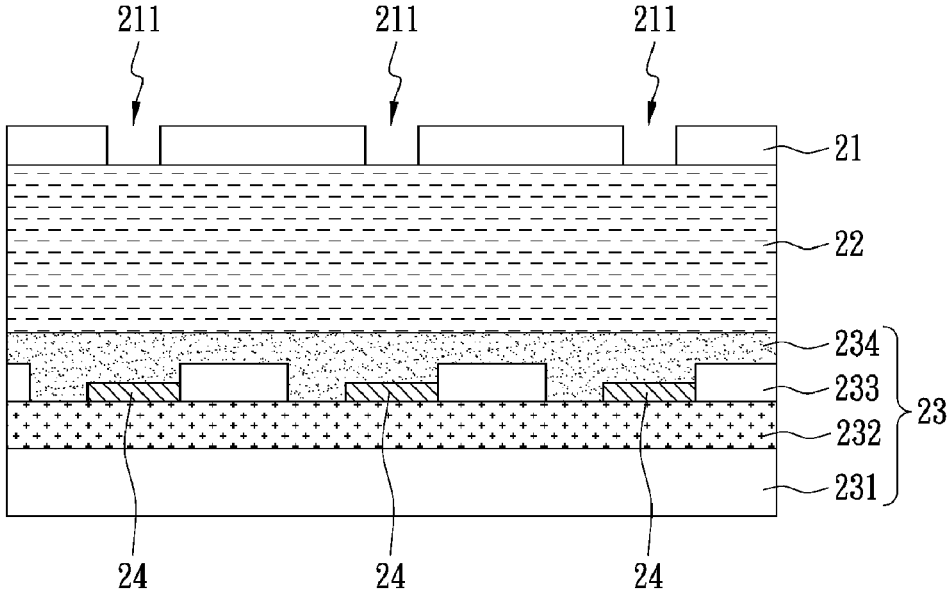
FIG. 3 is a sectional view of FIG. 2 taken along the section line 1-1.
Figure 4A:
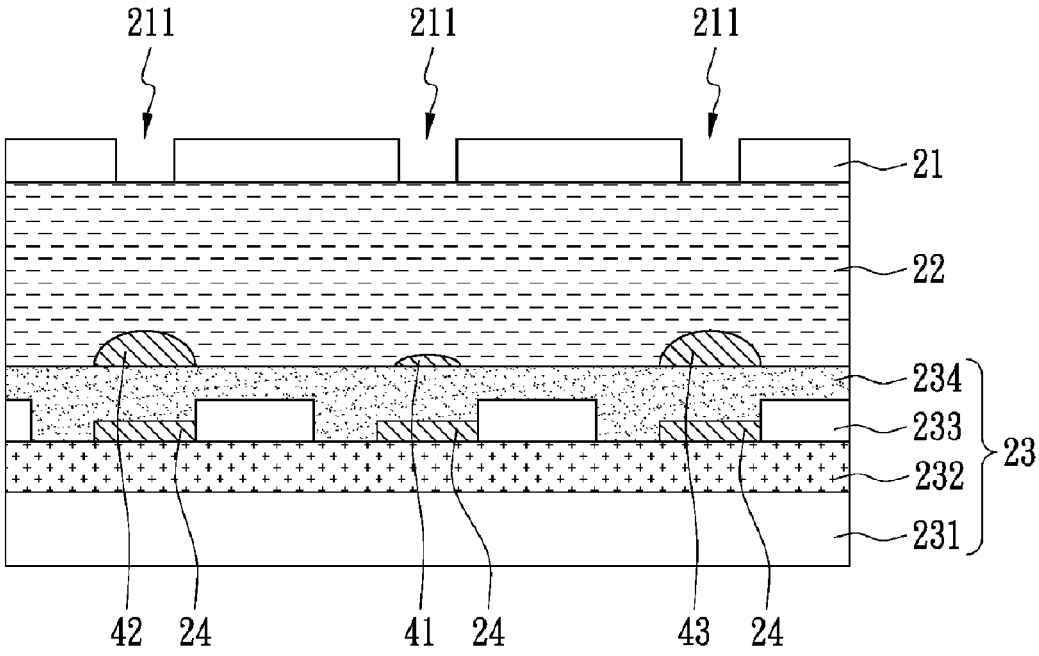
FIGS. 4(*a*)-4(*e*) are schematic views of the bubble growth and the droplet ejection of the micro-droplet ejection apparatus.
Figure 4B:
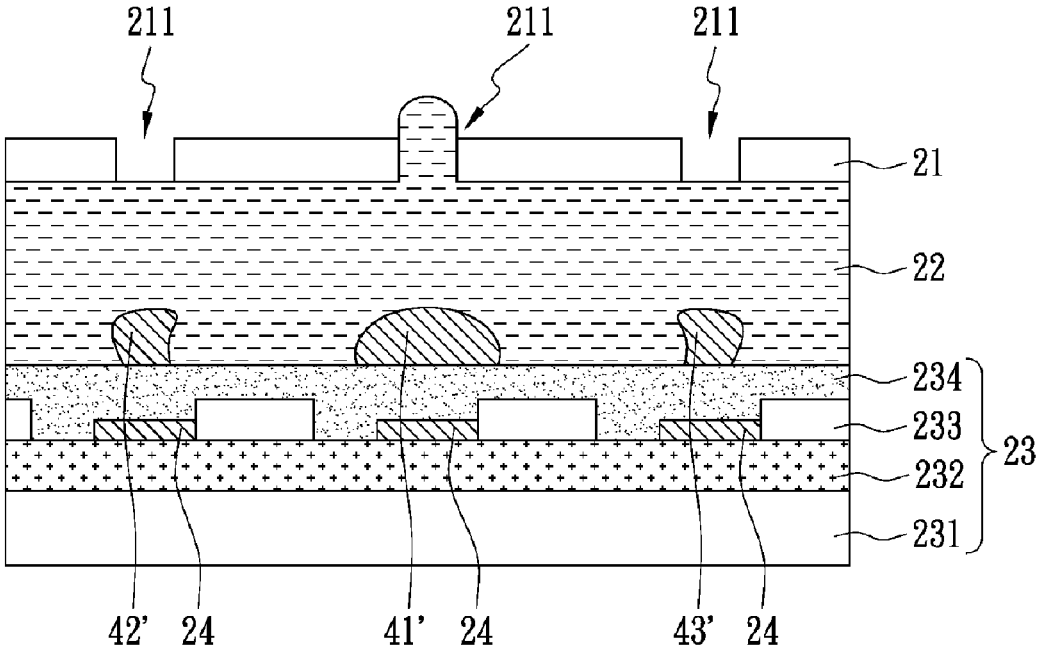
Figure 4C:
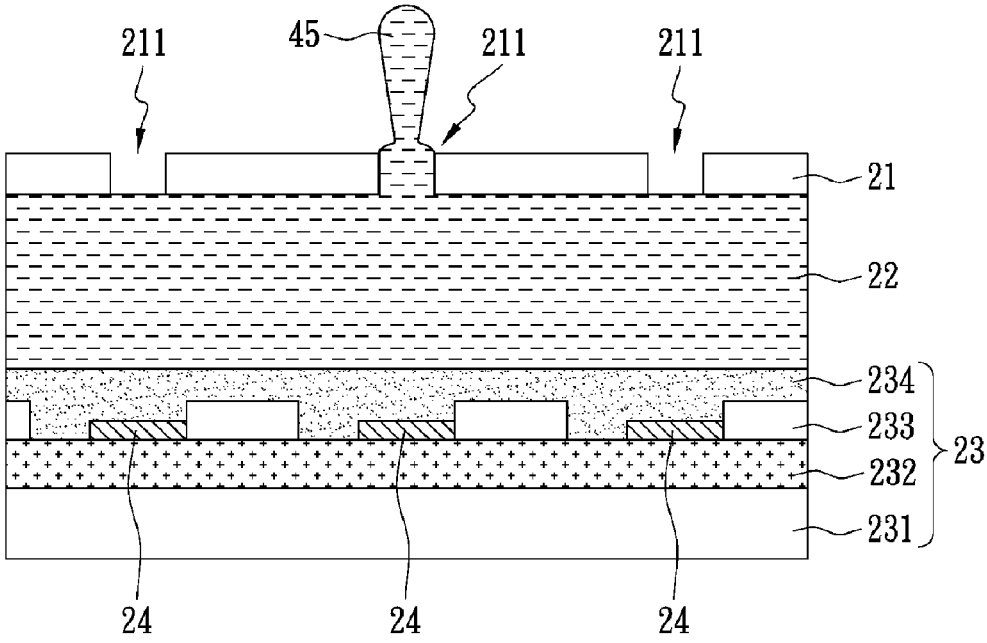
Figure 4D:
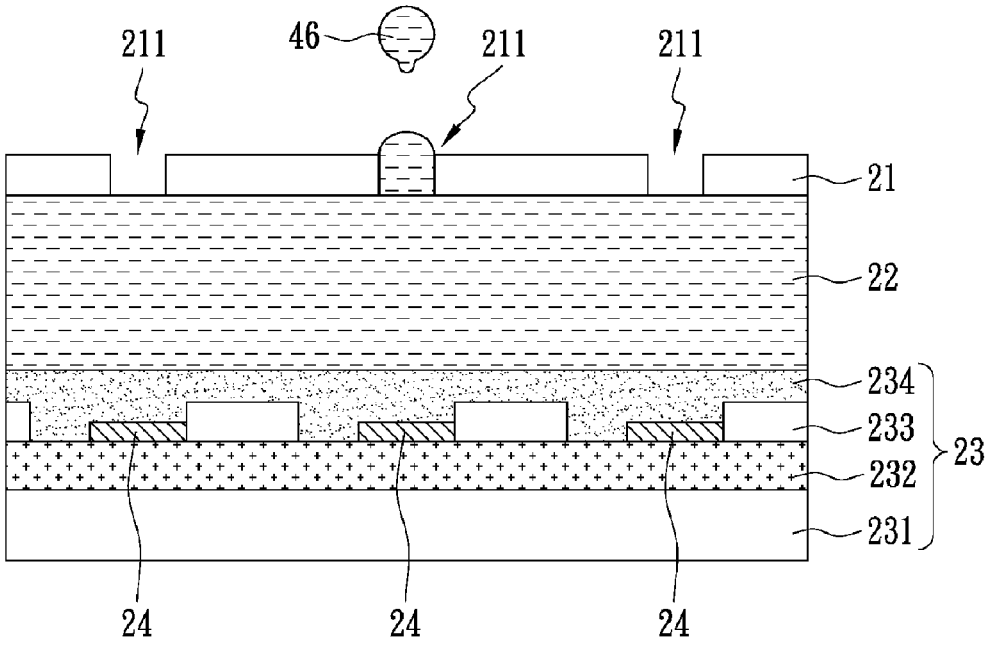
Figure 4E:
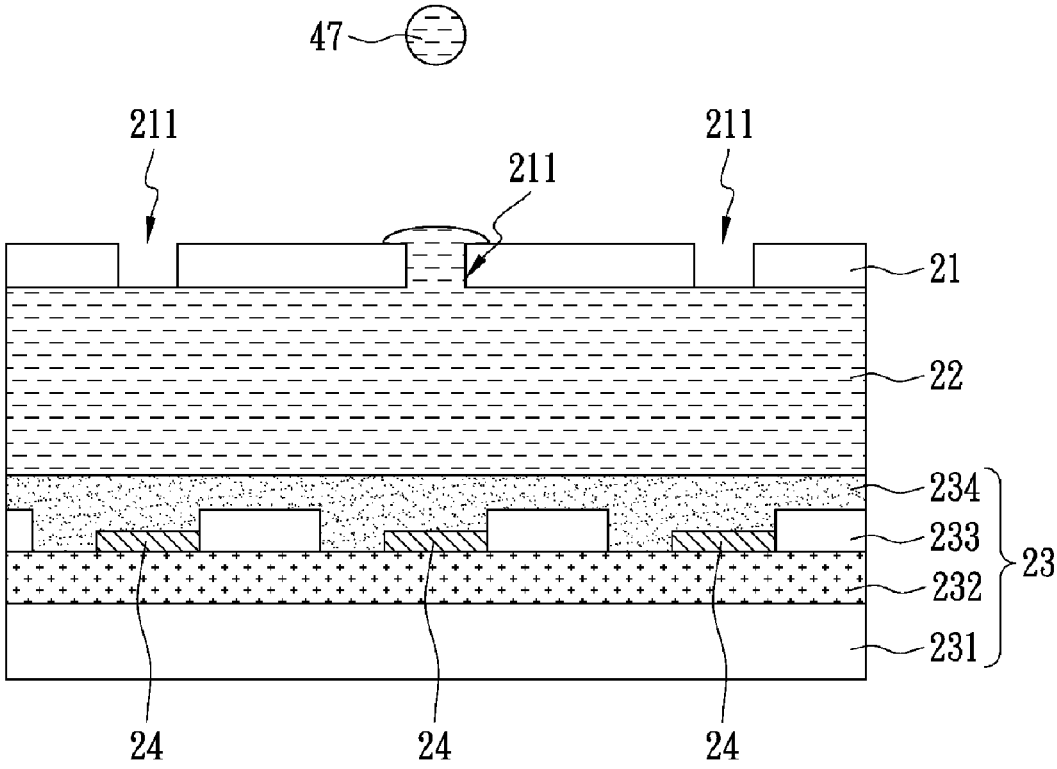

FIG. 3 is a sectional view of FIG. 2 taken along the section line 1-1. A plurality of bubble generators 24 is disposed on a silicon substrate 231, and is disposed under the corresponding through holes 211. Each of the bubble generators 24 can be a heating electrode or other elements capable of generating bubbles. A current pulse flows to the electrodes through wires 233, and the instantly heated electrodes vaporize the contacted liquid to form the bubbles. The electrodes can be a thin film of Pt, and the wires 233 are a thin film formed by deposition of an Al material. Commonly, the heat conduction coefficient of the silicon substrate 231 is superior to that of most of metal, so a heat insulating layer, for example, a silicon dioxide layer 232, is formed between the bubble generators 24 and the silicon substrate 231. The silicon dioxide layer 232 is used to reduce the heat loss of the bubble generators 24. In addition, a passive layer 234 with low stress, e.g., silicon nitride, is deposited on the surface of the bubble generators 24 and the wires 233, and is used as a passive protective layer.

FIGS. 4(*a*)-4(*e*) are schematic views of the bubble growth and the droplet ejection of the micro-droplet ejection apparatus. A middle through hole 211 is the nozzle currently designated to eject the droplets, and the through holes 211 on both sides are not the nozzles currently designated to eject the droplets at the same time. The bubble generators 24 on both sides firstly supply the current pulse to generate a second bubble 42 and a third bubble 43, and then supply the current pulse to the middle bubble generator 24 to generate a first bubble 41 after delaying for several microseconds. The current pulse can make the bubble generators 24 generate the high heat flux and last for several microseconds, for example, generate the heat flux of 1.3 $GW/m^2$, and last for 3 μs. The first bubble 41, the second bubble 42, and the third bubble 43 can be formed and grown together at the same time as the current pulse is supplied. Meanwhile, the second bubble 42 and the third bubble 43 cause the pressure to affect the direction of the growth of the first bubble 41, so as to prevent the first bubble 41 from expanding towards the direction in which the hydraulic pressure is smaller. As shown in FIG. 4(*b*), when the supply of the current pulse to the three bubble generators 24 is stopped, the size of the middle first bubble 41 continuously grows to form a first bubble 41', and the second bubble 42 and the third bubble 43 are affected by the first bubble 41' to respectively become a second bubble 42' and a third bubble 43' with smaller volumes.

When the volume of the first bubble 41' continuously grows, the liquid near the middle through hole 211 is gradually pushed out of the liquid storage space 25. As shown in FIG. 4(*b*), an exposed hemisphere liquid protruding portion 44 is formed at the through hole 211, and the volume of the liquid protruding portion 44 becomes bigger with the expansion of the first bubble 41'. When the first bubble 41' grows to a maximum size, it does not continue to expand, but increasingly shrinks. Then, it is cooled by the ink 22 surrounding it, and finally disappears in the ink 22. As shown in FIG. 4(*c*), the liquid protruding portion 44 becomes a liquid column 45 that is about to leave the through hole 211. At this time, the first bubble 41' has shrunk and disappeared.

As shown in FIGS. 4(*d*)-4(*e*), the liquid column 45 is pushed out of the through hole 211 because of the pressure of the expanding first bubble 41', and becomes a flying liquid drop 46 with an irregular shape. Affected by the surface tension, the flying liquid drop 46 increasingly becomes a droplet 47.

Figure 5:
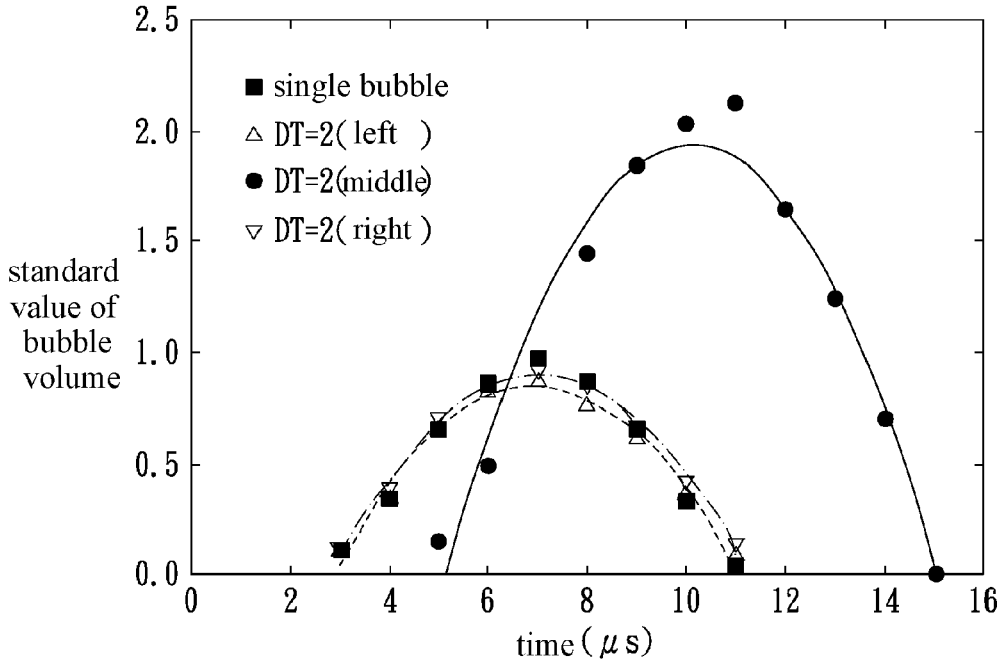
FIG. 5 is a recording diagram of the bubble growth and shrinkage under a state that DT is set to 2 μs.

FIG. 5 is a recording diagram of the bubble growth and shrinkage in a state in which the delay time (DT) is set to 2 μs. The symbol ■ in the figure represents the change in the volume of the bubble obtained when the current pulse is supplied to a single bubble generator 24. The obtained maximum volume is set as a standard volume, and the subsequent calculation of the volume of each bubble is standardized on the basis of the maximum volume. The symbols Δ, ●, ∇ respectively represent the changes in the volumes of the second bubble 42, the first bubble 41, and the third bubble 43 in FIG. 4(*a*). Further, the current pulse is supplied to the middle bubble generator 24 after it is supplied to the bubble generators 24 on the left and right sides and remains for two milliseconds, so the delay time (DT) is two microseconds (DT=2). The changes in the volumes of the second bubble 42 and the third bubble 43 are approximately the same, but the generated first bubble 41 can grow to two times the standard volume when the supply of the current pulse is delayed for two microseconds, so as to shorten the period of ejecting the droplet.

Figure 6:
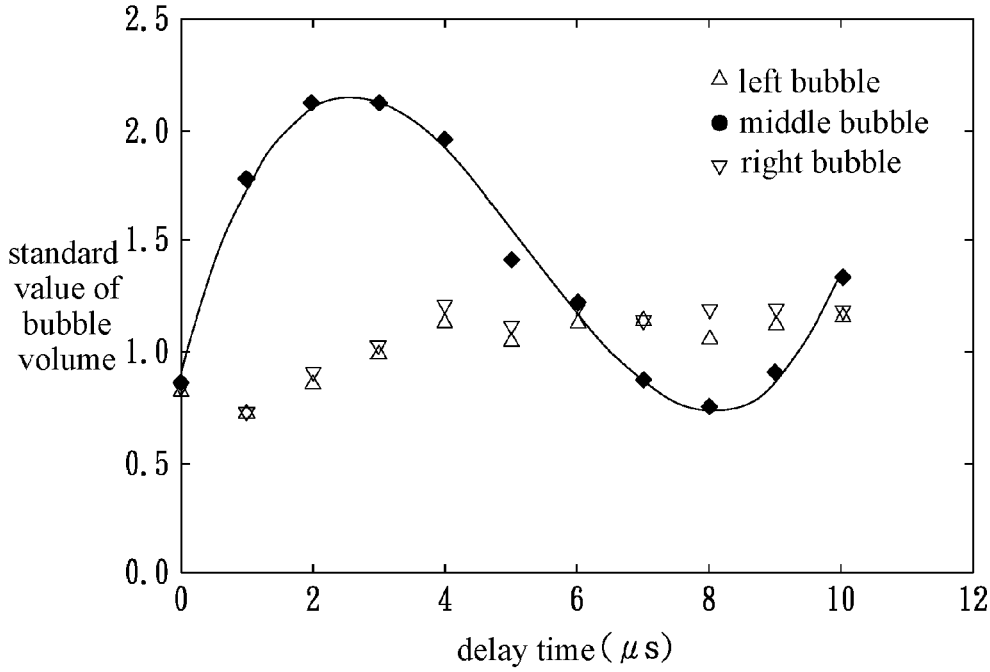
FIG. 6 is a relation diagram of the change in DT and the maximum volume of the bubble.

FIG. 6 is a relation diagram of the change in the DT and the maximum volume of the bubble. The DT is controlled in 2 to 3 seconds to make the maximum volume of the first bubble 41 approximately two times the standard volume, thereby obtaining an optimum droplet ejection control by adjusting the DT.

Figure 7:
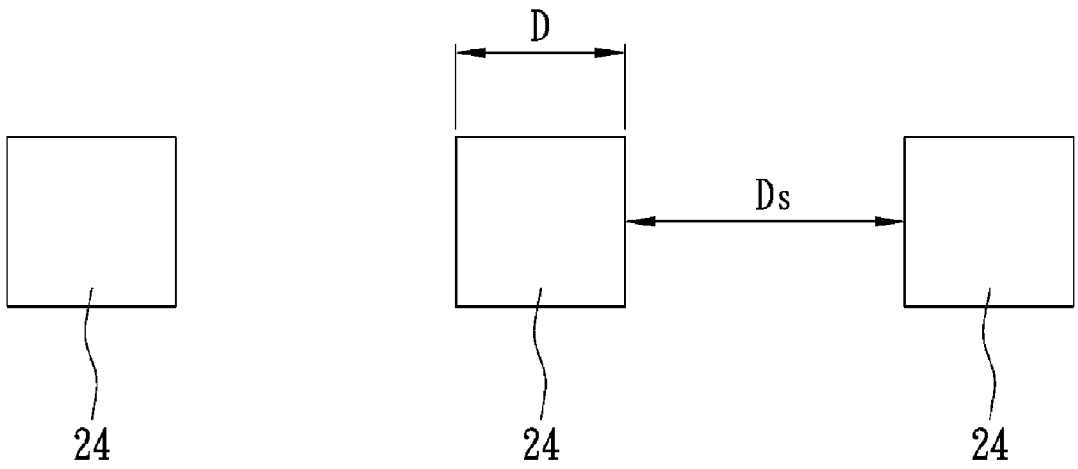
FIG. 7 is a schematic view of the size of and the distance between the bubble generators.

In addition, the distance Ds between the bubble generators 24 is also relevant to the maximum volume of the first bubble 41. FIG. 7 is a schematic view of the size of and the distance between the bubble generators. The width of the bubble generators 24 in the figure is D, and the distance between the bubble generators is Ds. When the ratio of the distance Ds to the width D is greater than three, the change in the volume of the first bubble 41 is no longer relevant to the second bubble 42 and the third bubble 43.

Figure 8:
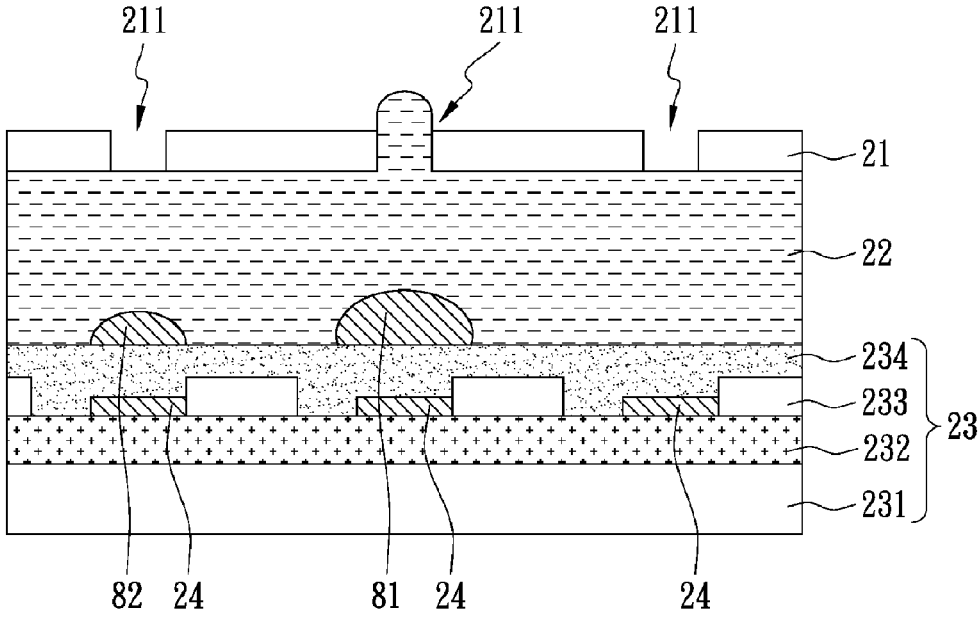
FIG. 8 is a sectional view of the micro-droplet ejection apparatus according to another embodiment of the present invention.

In the embodiment of FIGS. 4(*a*)-4(*e*), the second bubble 42 and the third bubble 43 on the two sides are used to control the growth of the main first bubble 41 in the middle. However, as shown in FIG. 8, if the growth of the main bubble 81 and the limit bubble 82 on one side can be precisely controlled, the ink 22 can also be pushed out of the through hole 211.

Figure 9:
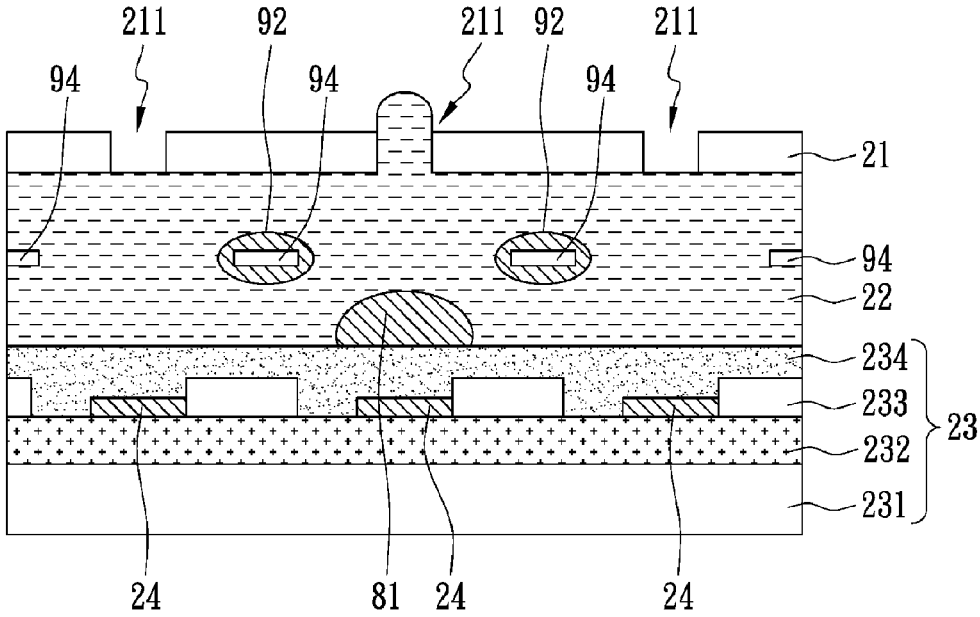
FIG. 9 is a sectional view of the micro-droplet ejection apparatus according to another embodiment of the present invention.

As shown in FIG. 9, the limit bubbles 92 on the two sides can also be formed by auxiliary bubble generators 94 immersed in the ink 22, that is, the auxiliary bubble generators 94 are further disposed on the periphery of the bubble generators 24. The auxiliary bubble generators 94 can be cantilever-beam-type heating electrodes, or other elements capable of generating the bubbles, for example ultrasonic elements. The bubble generators 24 can also be disposed in the liquid storage space 25 filled with the ink 22 in a way similar to that of the auxiliary bubble generators 94, so as to replace the bubble generators 24 directly disposed on the silicon substrate 231. Similarly, the auxiliary bubble generators 94 can also be disposed on the silicon substrate 231, and located at positions not overlapping the bubble generators 24.

Figure 10:
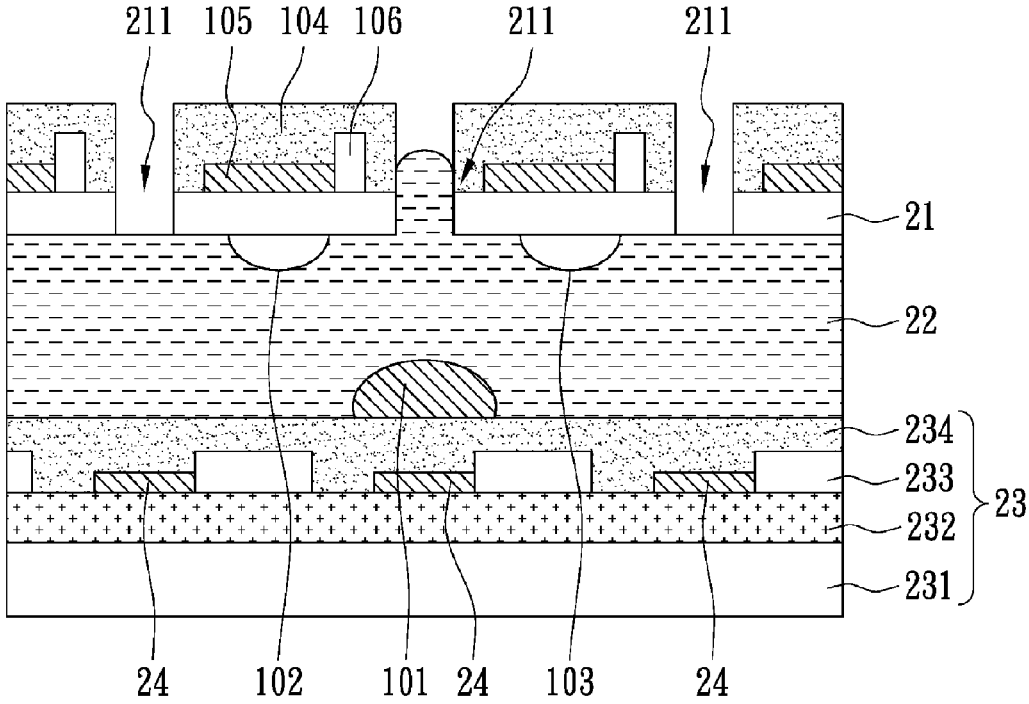
FIG. 10 is a sectional view of the micro-droplet ejection apparatus according to another embodiment of the present invention.

FIG. 10 is a sectional view of the micro-droplet ejection apparatus according to another embodiment of the present invention. Compared with the embodiment in FIG. 9, the main bubble 101 of this embodiment is still generated by the bubble generator 24 disposed on the silicon substrate 231, and the limit bubble 102 is generated by the auxiliary bubble generator 94 disposed on the droplet-ejecting layer 21. The limit bubbles 102 and 103 gradually expand from top to bottom, but similarly, the main bubble 101 is also limited and continuously grows. Each auxiliary bubble generator 105 has a wire 106 for connection, so as to supply the current pulse to instantly raise the temperature of the auxiliary bubble generator 105. A passive layer 104 covers the wires 233 and the auxiliary bubble generators 105.

Figure 11A:
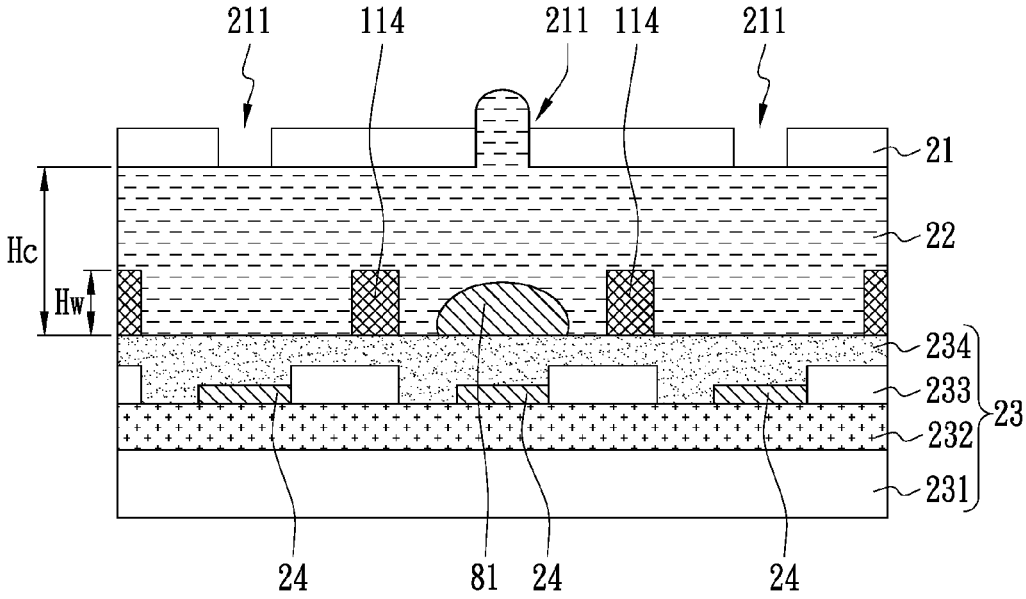
FIG. 11(*a*) is a sectional view of the micro-droplet ejection apparatus according to another embodiment of the present invention.
Figure 11B:
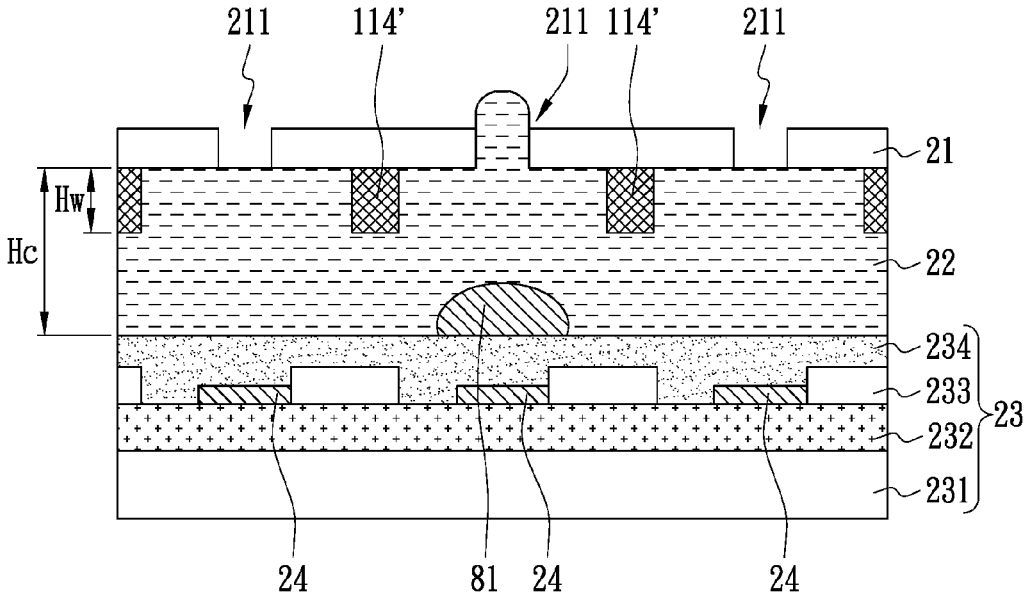

FIG. 11(*a*) is a sectional view of the micro-droplet ejection apparatus according to another embodiment of the present invention. Bumps 114 disposed on the passive layer 234 are used to replace the limit bubbles on the two sides. That is, the bumps 114 are further disposed on the periphery of the bubble generators 24 to control the growth of the middle main bubble 81. The bumps 114' can also be formed on a lower surface of the droplet-ejecting layer 21, as shown in FIG. 11(*b*). Further, the ratio of the height Hw of the bumps 114 or 114' to the height Hc of the liquid storage space 25 is preferably smaller than 0.5.

The aforementioned descriptions of the present invention are intended to be illustrative only. Numerous alternative methods may be devised by persons skilled in the art without departing from the scope of the following claims.

What is claimed is:

1. A micro-droplet ejection apparatus having nozzle arrays without individual chambers, comprising:

a substrate;

a droplet-ejecting layer having a plurality of through holes arranged in an array, wherein a liquid storage space is formed between the substrate and droplet-ejecting layer and filled with liquid;

a plurality of bubble generators respectively disposed under each of the through holes;

wherein a designated bubble generator generates a main bubble, at least one limit bubble is generated on the periphery of the main bubble, and the limit bubble controls growth of the main bubble, wherein the main bubble is generated later than the limit bubble; and a plurality of auxiliary bubble generators surrounded by the liquid in the liquid storage space, wherein the limit bubble is generated by the auxiliary bubble generators.

2. The micro-droplet ejection apparatus having nozzle arrays without individual chambers of claim 1, wherein the limit bubble controls the direction and volume of the growth of the main bubble.

3. The micro-droplet ejection apparatus having nozzle arrays without individual chambers of claim 1, wherein each of the bubble generators is an electrode capable of generating heat for heating liquid to form a bubble.

4. The micro-droplet ejection apparatus having nozzle arrays without individual chambers of claim 1, wherein the substrate further comprises a heat-insulating layer, and the bubble generators are disposed on the heat-insulating layer.

5. The micro-droplet ejection apparatus having nozzle arrays without individual chambers of claim 4, wherein the heat-insulating layer is a silicon dioxide layer.

6. The micro-droplet ejection apparatus having nozzle arrays without individual chambers of claim 1, wherein the substrate further comprises a passive layer covering the bubble generators.

7. The micro-droplet ejection apparatus having nozzle arrays without individual chambers of claim 1, wherein the substrate further comprises a plurality of wires connected with the plurality of bubble generators.

8. The micro-droplet ejection apparatus having nozzle arrays without individual chambers of claim 1, wherein a distance between the bubble generators is smaller than three times a width of the bubble generators.

9. The micro-droplet ejection apparatus having nozzle arrays without individual chambers of claim 1, wherein the bubble generators are disposed on the substrate.

10. The micro-droplet ejection apparatus having nozzle arrays without individual chambers of claim 1, wherein the bubble generators are disposed on the droplet-ejecting layer.

11. The micro-droplet ejection apparatus having nozzle arrays without individual chambers of claim 1, wherein the bubble generators are disposed in the liquid storage space.

12. The micro-droplet ejection apparatus having nozzle arrays without individual chambers of claim 1, wherein the auxiliary bubble generators are disposed on the droplet-injecting layer.

13. The micro-droplet ejection apparatus having nozzle arrays without individual chambers of claim 1, wherein the auxiliary bubble generators are disposed in the liquid storage space.

14. An ejection method for droplets, comprising:

forming a limit bubble in liquid filled in a liquid storage space and on at least one side of a designated nozzle in a nozzle array, wherein the nozzle array is without individual chambers, wherein the limit bubble is generated by an auxiliary bubble generator surrounded by the liquid;

forming a main bubble in the liquid under the designated nozzle orifice, wherein the main bubble is generated later than the limit bubble; and controlling formation of the main bubble with the limit bubble, so that the continuously growing main bubble pushes a droplet away from the designated nozzle.

15. The ejection method of droplets of claim 14, further comprising a step of controlling a time sequence of generating the main bubble and the limit bubble.

16. The ejection method of droplets of claim 14, wherein the main bubble grows to a maximum volume, and then gradually shrinks and disappears in the liquid.

17. The ejection method of droplets of claim 14, wherein the limit bubble grows to a maximum volume, and then gradually shrinks and disappears in the liquid.

18. A micro-droplet ejection apparatus having nozzle arrays without individual chambers, comprising:

a substrate;

a droplet-ejecting layer having a plurality of through holes arranged in an array, wherein a liquid storage space is formed between the droplet-ejecting layer and the substrate;

a plurality of bubble generators respectively disposed under each of the through holes; and a plurality of bumps respectively disposed around the bubble generators;

wherein a designated bubble generator generates a main bubble, and at least one bump controls growth of the main bubble;

wherein the substrate further comprises a passive layer covering the bubble generators;

wherein the plurality of bumps are formed above the passive layer.

19. The micro-droplet ejection apparatus having nozzle arrays without individual chambers of claim 18, wherein the bump controls the direction and volume of the growth of the main bubble.

20. The micro-droplet ejection apparatus having nozzle arrays without individual chambers of claim 18, wherein each of the bubble generators is an electrode capable of generating heat for heating liquid to generate the bubbles.

21. The micro-droplet ejection apparatus having nozzle arrays without individual chambers of claim 18, wherein the substrate further comprises a heat-insulating layer, and the bubble generators are disposed on the heat-insulating layer.

22. The micro-droplet ejection apparatus having nozzle arrays without individual chambers of claim 21, wherein the heat-insulating layer is a silicon dioxide layer.

23. The micro-droplet ejection apparatus having nozzle arrays without individual chambers of claim 18, wherein the substrate further comprises a plurality of wires connected with the plurality of bubble generators.

24. The micro-droplet ejection apparatus having nozzle arrays without individual chambers of claim 18, wherein a height of the bump is smaller than half of the height of the liquid storage space.

25. The micro-droplet ejection apparatus having nozzle arrays without individual chambers of claim 18, wherein a distance between the bubble generators is smaller than three times a width of the bubble generators.

26. The micro-droplet ejection apparatus having nozzle arrays without individual chambers of claim 18, wherein the bubble generators are disposed on the substrate or the droplet-ejecting layer.

27. A micro-droplet ejection apparatus having nozzle arrays without individual chambers, comprising:

a substrate;

a droplet-ejecting layer having a plurality of through holes arranged in an array, wherein a liquid storage space is formed between the substrate and droplet-ejecting layer and filled with liquid;

a bubble generator disposed on the substrate;

wherein the bubble generator generates a main bubble, at least one limit bubble is generated on the periphery of the main bubble, and the limit bubble controls growth of the main bubble, wherein the main bubble is generated later than the limit bubble; and a plurality of auxiliary bubble generators surrounded by the liquid in the liquid storage space, wherein the limit bubble is generated by the auxiliary bubble generators.

* * * * *